US005242065A

United States Patent [19]

Hoban

[11] Patent Number: 5,242,065

[45] Date of Patent: Sep. 7, 1993

[54] CURTAIN ROD WITH LOCKABLE FITTING

[75] Inventor: Michael B. Hoban, Bellville, Wis.

[73] Assignee: Springs Window Fashions Division, Inc., Middleton, Wis.

[21] Appl. No.: 989,711

[22] Filed: Dec. 14, 1992

[51] Int. Cl.[5] ..... A47F 7/00

[52] U.S. Cl. ..... 211/105.6; 211/105.3

[58] Field of Search ..... 211/105.6, 105.3, 105.1, 211/123

[56] References Cited

U.S. PATENT DOCUMENTS

| | | | |
|---|---|---|---|
| 2,399,001 | 4/1946 | Chilton | 211/105.6 |
| 2,509,521 | 5/1950 | Pegram | 211/105.3 |
| 2,698,094 | 12/1954 | Simpson | 211/105.3 |
| 2,973,870 | 3/1961 | Schoos . | |
| 3,074,740 | 1/1963 | Zastrow . | |
| 3,110,506 | 11/1963 | O'Brien . | |
| 3,137,890 | 6/1964 | Kockanowski . | |
| 3,506,135 | 4/1970 | Klingaman . | |
| 3,570,412 | 3/1971 | Holman, Jr. | 211/105.6 X |
| 4,744,471 | 5/1988 | Leister | 211/105.6 X |

*Primary Examiner*—Karen J. Chotkowski
*Assistant Examiner*—Sarah Lechok
*Attorney, Agent, or Firm*—Vernon J. Pillote

[57] ABSTRACT

A lockable fitting for a curtain rod of the type having lengthwise extending rod flanges, the lockable fitting including a latch body movable along the rod and a latch member having first and second pairs of fingers with the fingers of each pair disposed at relatively opposite sides of a respective one of the rod flanges. The latch member is mounted on the body for movement between a release position in which the fingers of each pair loosely receive the associated rod flange and a lock position in which the fingers of each pair grip the associated rod flange means therebetween.

14 Claims, 2 Drawing Sheets

CURTAIN ROD WITH LOCKABLE FITTING

Some spring mounted rods and poles such as disclosed in U.S. Pat. No. 2,973,870, interpose a spring between an abutment that is fixed to one telescopic member and an abutment that is fixed to the other telescopic member. However, since the spring force decreases as the telescoping members are extended, such spring mounted rods can only accommodate a limited variation in length. In order to provide a high spring force over a longer range of adjustment, some spring mounted rods such as disclosed in U.S. Pat. Nos. 3,137,890 and 3,506,135, provide a spring abutment that can be adjusted along one rod section and locked in position on that section. Some other spring mounted rods and bars such as disclosed in U.S. Pat. Nos. 3,074,740 and 3,110,506, provide devices that are adjustable to lock telescopic rod sections with different adjusted positions.

SUMMARY OF THE INVENTION

Various objects of the present invention are to provide a lockable fitting for use in curtain rods which can be easily adjusted along the rod and locked in a selected position; which can be operated from a position in front of the rod and which does not require use of any tools, and which can withstand relatively high forces which would tend to shift the fitting relative to the rod.

Accordingly, the present invention provides a lockable fitting for a curtain rod means of the type having lengthwise extending rod flanges, the lockable fitting including a latch body movable along the rod and a latch member having first and second pairs of fingers with the fingers of each pair disposed at relatively opposite sides of a respective one of the rod flanges. The latch member is mounted on the body for movement between a release position in which the fingers of each pair loosely receive the associated rod flange and a lock position in which the fingers of each pair grip the associated rod flange means therebetween. Means are provided for retaining the latch member in the lock position.

The lockable fitting is adapted for use in spring mounted rods having telescopically adjustable inner and outer rod sections, to provide a spring abutment that can be adjusted along the rod and locked in the adjusted position to provide the desired spring loading for the spring mounted rod. The lockable fitting can be used to lock telescopically adjustable inner and outer rod sections against relative movement in selected adjusted positions.

The lockable fitting in the present invention is generally adapted for use in curtain rods designated generally by the numeral 10 of the type having opposed lengthwise extending rod flanges, and is particularly adapted for use in curtain rods having inner and outer telescopically adjustable rod sections respectively designated 11 and 12. The rod sections respectively include a front wall 11*a*, 12*a* and rolled edges that terminate in opposed lengthwise extending flanges 11*b*, 12*b*.

Figure 1:
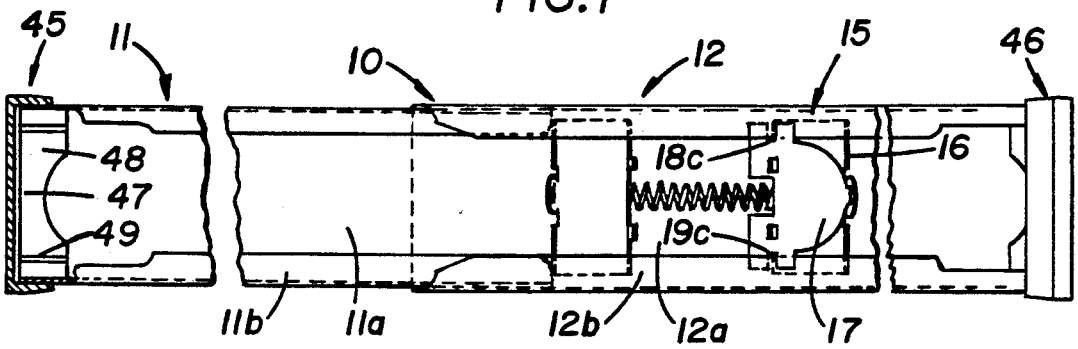
FIG. 1 is a rear elevational view of a spring mounted rod embodying the present invention, with parts broken away to illustrate details of construction.
Figure 2:
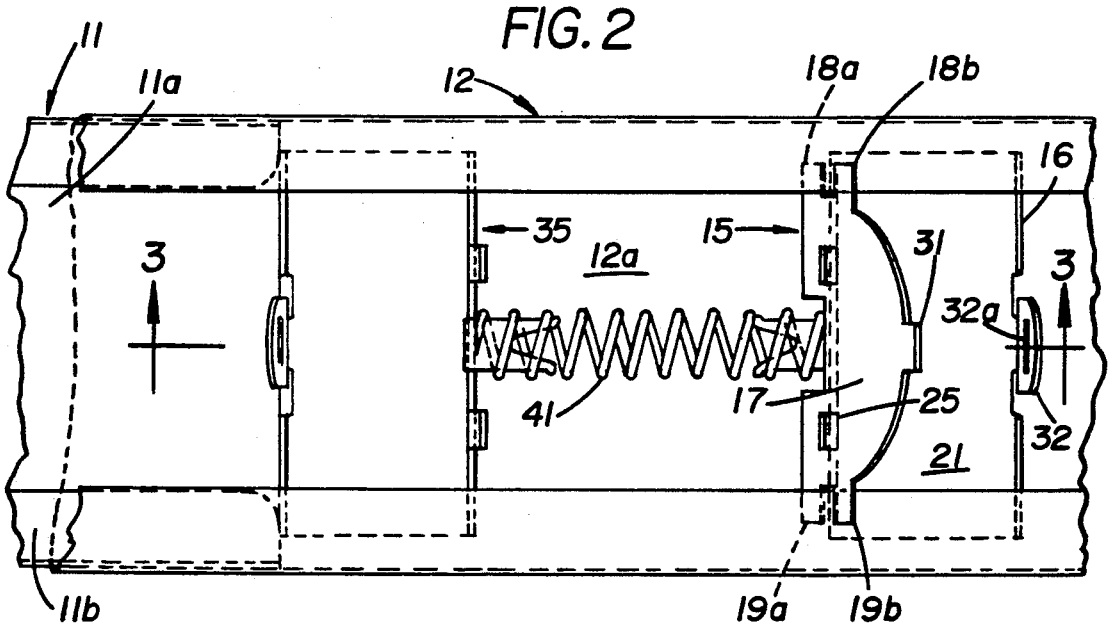
FIG. 2 is a fragmentary rear elevational view on a larger scale than FIG. 1 and illustrating the lockable fitting in a rod release condition.
Figure 3:
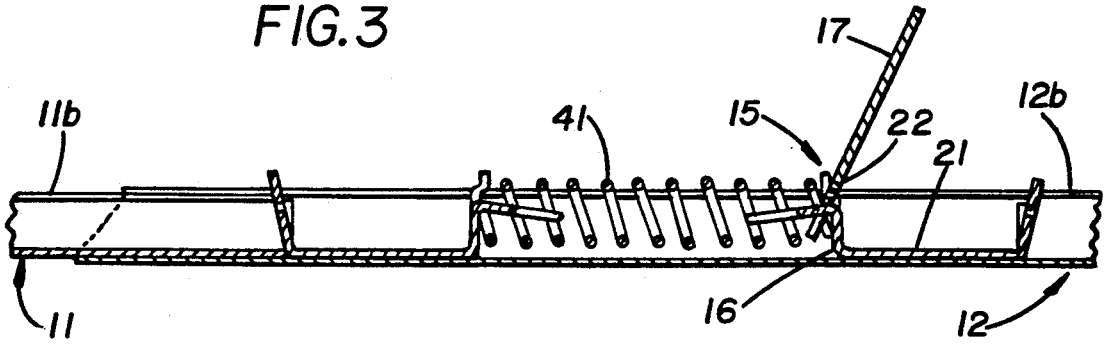
FIG. 3 is a fragmentary sectional view taken on the plane 3—3 of FIG. 2.
Figure 4:
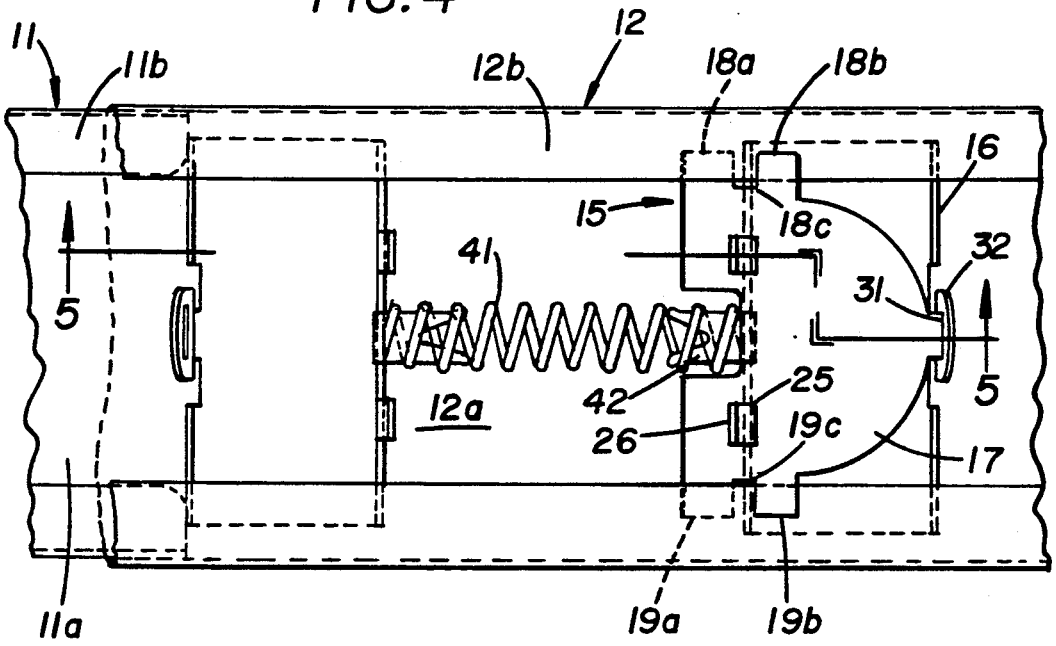
FIG. 4 is a fragmentary rear elevational view illustrating the lockable fitting in a lock position.
Figure 5:
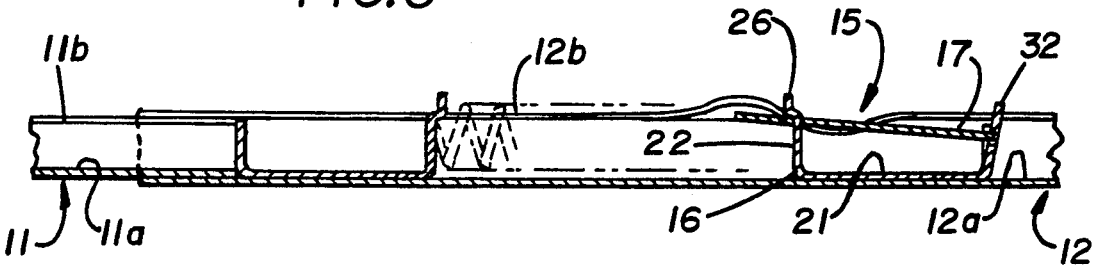
FIG. 5 is a fragmentary sectional view taken on the plane 5—5 of FIG. 4.

A lockable fitting designated generally by the numeral 15 includes a latch body 16 that is movable along the rod and a latch member 17 for locking the fitting on the flanges of the rod. The latch member 17 is a one-piece member having a first pair of fingers 18*a*, 18*b* spaced apart to provide a first flange receiving notch 18*c* therebetween and a second pair of fingers 19*a*, 19*b* spaced apart to provide a second flange receiving notch 19*c* therebetween. The pairs of fingers 18*a*, 18*b* and 19*a*, 19*b* extend from the latch member in relatively opposite directions and the notches 18*c*, 19*c* are disposed on a hinge line or axis that extends between the notches. The fingers 18*a*, 18*b* of the first pair and fingers 19*a*, 19*b* of the second pair are disposed at relatively opposite sides of a respective one of the rod flanges and the latch member is movable between a release position as shown in FIGS. 2 and 3 in which the fingers of each pair releasably receive an associated one of the rod flanges, and a lock position as shown in FIGS. 4 and 5 in which the fingers of each pair grip the associated rod flange therebetween. The latch plate is preferably formed of metal having a gauge or thickness greater than that of the curtain rod sections and such that the fingers can deform the rod flanges when the latch member is in its lock position as shown in FIG. 5.

The latch member 17 is mounted on the body 16 for swinging movement relative thereto about the aforementioned hinge axis generally aligned with the notches 18*c*, 19*c* between the release position and the lock position. The body 16 is preferably formed of sheet metal having a gauge heavier than that of the curtain rod sections and includes a plate portion 21 that is slidable along the rear face of the front wall of the rod section, and a flange 22 extending laterally of the plate portion 21 and crosswise of the length of the rod section. The latch plate 17 has a pair of openings 25 disposed along the hinge line that extends between the notches 18*c* and 19*c*, and the flange 22 has upwardly extending ears 26 that project through the openings 25 to swingably support the latch member. As best shown in FIGS. 3 and 5, the ears 26 have an offset upper portion arranged to engage the latch member when it is in a preselected raised position in which the finger loosely receive the rod flanges. The means for retaining the latch member in the lock position includes a latch nose 31 on the latch member 17, and the keeper 32 on the body 16. The keeper is formed integrally with the body and has an opening 32*a* for receiving the latch nose 31. As best shown in FIGS. 3 and 5, the keeper 32 is inclined to diverge slightly from the path of travel of the latch nose so that the latch nose cams the keeper outwardly until the nose registers with the slot 32*a* and allows the keeper to spring back into a position to help retain the latch nose. The keeper can be manually pressed in a direction to release the latch nose 31, if desired to readjust the position of the lockable fitting on the rod. As shown in FIGS. 2 and 4, the body 16 has a width measured in a direction crosswise of the rod that is greater than the spacing between the rod flanges, and the body flanges at least at the outer end portions of the body have a height slightly less than the spacing of the rod flanges from the rear side of the front wall, to allow free sliding of the body along the rod.

The lockable fitting is shown in FIG. 1-5 applied to a spring mounted type curtain rod. In this embodiment, a slide body 35 is slidably mounted on the outer rod section 12 and engages an end of the inner rod section 11. In order to minimize the number of different parts which need be made, the slide body 35 can conveniently be the same as the latch body 16. A compression spring 41 is interposed between the latch body 16 and the slide body 35 and locating ears 42 are provided on the slide body and latch body and arranged to extend into the compression spring to locate and retain the compression spring in position on the bodies. In this embodiment, the lockable fitting 15 provides an adjustable abutment for one end of the spring 41 to enable compressing the spring to the desired compression when the telescoping rods are adjusted to the desired length.

The spring mounted rod is spring biased into engagement with walls or other abutments. End fittings 45 and 46 are provided on the outer ends of the inner and outer rod sections and each includes a plate portion 47 dimensioned to overlie the end of the associated rod section and a flange portion 48 that extends into the associated rod section with reinforcing ribs 49 extending between the end plate and flange. The end fittings 45 and 46 are preferably formed of a relatively rigid plastic material and overlie and protectively cover the end of the associated rod section when threading a curtain thereover. Caps 51 of a relatively resilient material such as resilient plastic material are applied over the end fittings, preferably after threading of the curtain thereover, to aid in frictionally retaining the spring mounted rod in position. The end fittings 45 and 46 are preferably made of a slightly different size to conform to the cross-section of the associated rod section. However, the end caps are sufficiently resilient so that the same end caps can be used on both rod sections.

In installing the spring mounted rod between spaced abutments such spaced walls, the rod is first extended to a length to span the space between the walls, and then extended a further distance for example about one and one-half centimeters to provide a desired spring compression or preload when installed. The lockable fitting 15 is adjusted along the other rod section until the slide body 35 engages the end of the inner rod section. The latch member 17 is then moved from its release position shown in FIGS. 2 and 3 to its latch position shown in FIGS. 4 and 5 to lock the slide body 15 on the flanges of the outer rod section. The spring mounted rod can then be mounted between the walls by pushing one end of the rod and compressing to the telescoping rod sections enough to allow the other end of the rod sections to move into the space between the walls.

Figure 6:
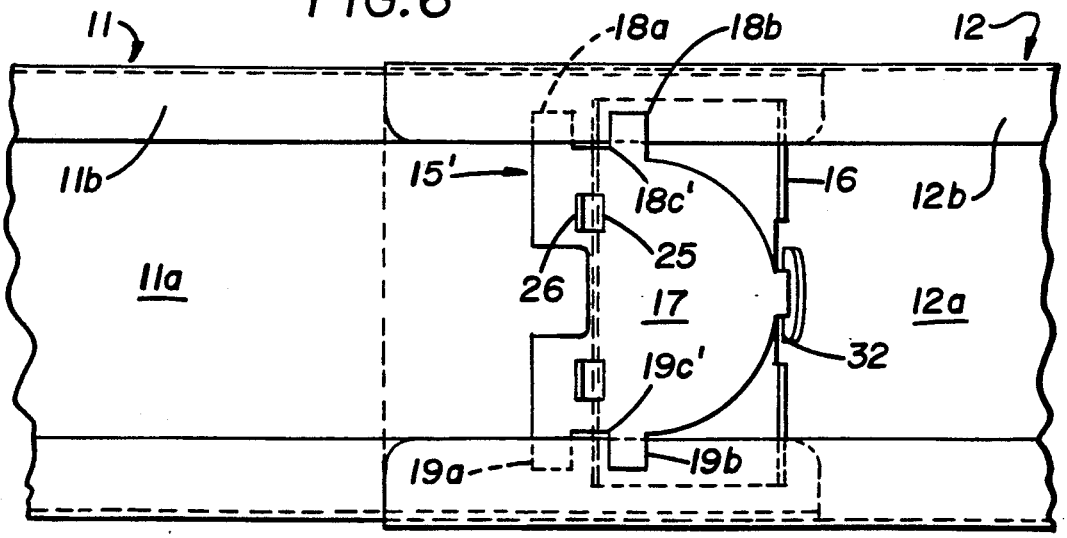
FIG. 6 is a fragmentary rear elevational view illustrating the lockable fitting holding telescopically adjustable inner and outer rod sections against relative movement.

In the embodiment of FIG. 6, the lockable fitting designated 15' is used to lock the telescoping rod sections 11 and 12 together after they have been adjusted to the desired length. The lockable fitting 15' is constructed and operates in the manner previously described in connection with FIGS. 1-5. However, this embodiment, the slide body 16 is dimensioned to be slidably received in the inner rod section 11 and the body flanges on the slide body, at least at the ends thereof, are dimensioned to be received between the flanges **11*b* and the rear side of the front wall 11*a* of the inner rod section. The latch member 17' is also the same as that previously described, with the notches 18*c*' and 19*c*'** made somewhat wider to accommodate the overlapping flanges on the inner and outer rod sections. Alternatively, the fingers of each pair could be bent or offset from each other to accommodate the increased thickness of the overlapping flanges.

The embodiments of the invention in which an exclusive property or privilege is claimed are defined as follows:

1. In an elongate curtain rod means having opposed lengthwise extending rod flange means, a lockable fitting including a latch body movable along the rod means and a latch member having first and second pairs of fingers with the fingers of each pair disposed at relatively opposite sides of a respective one of the rod flange means, means mounting the latch member on the latch body for swinging movement relative thereto between a release position in which the fingers of each pair loosely receive the associated rod flange means and a lock position in which the fingers of each pair grip the associated rod flange means therebetween, and means on the latch body and latch for retaining the latch member in the lock position.

2. The combination of claim 1 wherein said latch member comprises a plate, said plate extending generally lengthwise of the rod flange means in the lock position.

3. The combination of claim 2 wherein the means mounting the latch member on the latch body includes opening means in the latch member at a location intermediate the pairs of fingers, and ear means on the latch body extending into the opening means in the latch member to swingably support the latter.

4. The combination of claim 2 wherein the means for retaining the latch member in the lock position includes a latch nose on the latch member and a keeper on the latch body engageable with the latch nose.

5. The combination of claim 1 wherein the latch body has a plate portion and body flange means extending transverse to the plate portion, the fingers of each pair defining a flange receiving notch therebetween, the latch member having opening means therein located along a line extending between the notches, the body flange means having ear means extending through the opening means in the latch member and supporting the latch member for swinging movement relative to the latch body between a release position extending transverse to the rod flange means and a lock position extending generally lengthwise of the rod flange means, the latch member having a latch nose spaced from the opening means, and a keeper on the latch body engageable with the latch nose for retaining the latch member in the lock position.

6. A lockable fitting for curtain rod means having lengthwise extending rod flange means, the fitting including a latch body having a plate portion and body flange means extending transverse to the plate portion, a latch member having first and second pairs of fingers extending in relatively opposite directions with the fingers of each pair defining a flange receiving notch therebetween, the latch member having opening means therein located along a line extending between the notches, the body flange means having ear means extending through the opening means in the latch member and supporting the latch member for swinging movement relative to the latch body between a release position disposed at an angle to the plate portion and lock position disposed generally parallel to the plate portion, the latch member having a latch nose spaced from the opening means, and a keeper on the latch body engageable with the latch nose for retaining the latch member in the lock position.

7. The combination of claim 1 wherein said curtain rod means includes telescoping inner and outer rod sections, said latch body being movable along one of the rod sections.

8. The combination of claim 1 wherein said curtain rod means includes telescoping inner and outer rod sections each having opposed flanges, a slide body slidable in the outer rod section and engaging an end of the inner rod section, said latch body being slidable in the outer rod section, and compression spring means interposed between the slide body and the latch body.

9. The combination of claim 1 wherein said curtain rod means includes telescoping inner and outer rod sections each having opposed flanges, the latch body being slidable in the inner rod section, one finger of each pair being engageable with an inner side of the flange on the inner rod section and the other finger of each pair being engageable with an outer side of the flange on the outer rod section.

10. An adjustable spring mounted curtain rod including telescoping inner and outer rod members each having a front wall and opposed rod flanges extending lengthwise along a rear side of the front wall, a slide body slidable in the outer rod section and engageable with an end of the inner rod section, a latch body slidable in the outer rod section, a compression spring interposed between the slide body and the latch body, a latch member having first and second pairs of fingers extending in relatively opposite directions with the fingers of each pair defining a flange receiving notch therebetween, the fingers of each pair being disposed at relatively opposite sides of the flanges on said one of the rod sections, means mounting the latch member on the latch body for movement relative thereto between a release position in which the fingers of each pair loosely receive the associated rod flange and a lock position in which the fingers of each pair grip the associated rod flange therebetween, and means on the latch body and latch member for retaining the latch member in the lock position.

11. The combination of claim 10 wherein said latch member comprises a generally flat plate, said plate extending generally lengthwise of the rod flanges in the lock position.

12. The combination of claim 11 wherein means mounting the latch member on the latch body includes opening means in the latch member located along a line extending between the notches, and an ear on the latch body extending into the opening means in the latch member to swingable support the latter.

13. The combination of claim 12 wherein the means for retaining the latch member in the lock position includes a latch nose on the latch member and a keeper on the latch body engageable with the latch nose.

14. The combination of claim 10 wherein the latch body has a plate portion and flange means extending transverse to the plate portion, the latch member having opening means therein located along a line extending between the notches, the flange means having ear means extending through the opening mans in the latch member and supporting the latch member for swinging movement relative to the latch body between a release position disposed at an angle to the base wall and a lock position disposed generally parallel to the base wall, the latch member having a latch nose spaced from the opening means, and a keeper on the latch body engageable with the latch nose for retaining the latch member in the lock position.

* * * * *

UNITED STATES PATENT AND TRADEMARK OFFICE

CERTIFICATE OF CORRECTION

PATENT NO. : 5,242,065

DATED : September 7, 1993

INVENTOR(S) : Michael B. Hoban

It is certified that error appears in the above-identified patent and that said Letters Patent is hereby corrected as shown below:

Claim 1, column 4, line 24, delete "and latch";

Claim 6, column 5, line 1, insert -- a -- before "lock";

Claim 14, column 6, line 29, delete "mans" and insert -- means --.

Signed and Sealed this

Twenty-ninth Day of March, 1994

*Attest:*

*Attesting Officer*

Bruce Lehman

BRUCE LEHMAN

*Commissioner of Patents and Trademarks*